United States Patent [19]

Eftefield et al.

[11] 4,044,481

[45] Aug. 30, 1977

[54] REVERSIBLE BLADE BIT

[75] Inventors: Larry G. Eftefield; Paul J. Lukavich, both of Joliet, Ill.

[73] Assignee: Caterpillar Tractor Co., Peoria, Ill.

[21] Appl. No.: 665,731

[22] Filed: Mar. 11, 1976

[51] Int. Cl.[2] ..... E02F 9/28

[52] U.S. Cl. ..... 37/141 T; 172/703; 172/704

[58] Field of Search ..... 37/141 R, 141 T, 142 R, 37/142 A; 172/702, 703, 704, 719, 734–737

[56] References Cited

U.S. PATENT DOCUMENTS

| | | | |
|---|---|---|---|
| 2,831,275 | 4/1958 | Kimsey et al. | 37/141 R |
| 3,190,018 | 6/1965 | Nelson et al. | 37/141 R |
| 3,638,736 | 2/1972 | Hahn | 37/141 R |

FOREIGN PATENT DOCUMENTS

| | | | |
|---|---|---|---|
| 744,115 | 10/1966 | Canada | 172/719 |
| 541,626 | 4/1956 | Italy | 37/141 R |
| 1,333,480 | 10/1973 | United Kingdom | 137/141 R |
| 160,047 | 11/1962 | U.S.S.R. | 172/719 |

OTHER PUBLICATIONS

R.P.U. Note B & C copies provided by applicant.

*Primary Examiner*—E. H. Eickholt
*Attorney, Agent, or Firm*—Wegner, Stellman, McCord, Wiles & Wood

[57] ABSTRACT

A reversible bit for selective mounting to an earth-moving blade, such as a bulldozer blade, having opposite corner portions. The bit includes transversely extending cutting edge portions and a mounting portion adapted to be selectively mounted to opposite corners of the blade with one or the other of the cutting edge portions suitably disposed in cutting position whereby the bit provides substantially twice the normal life of the conventional blade bit.

6 Claims, 3 Drawing Figures

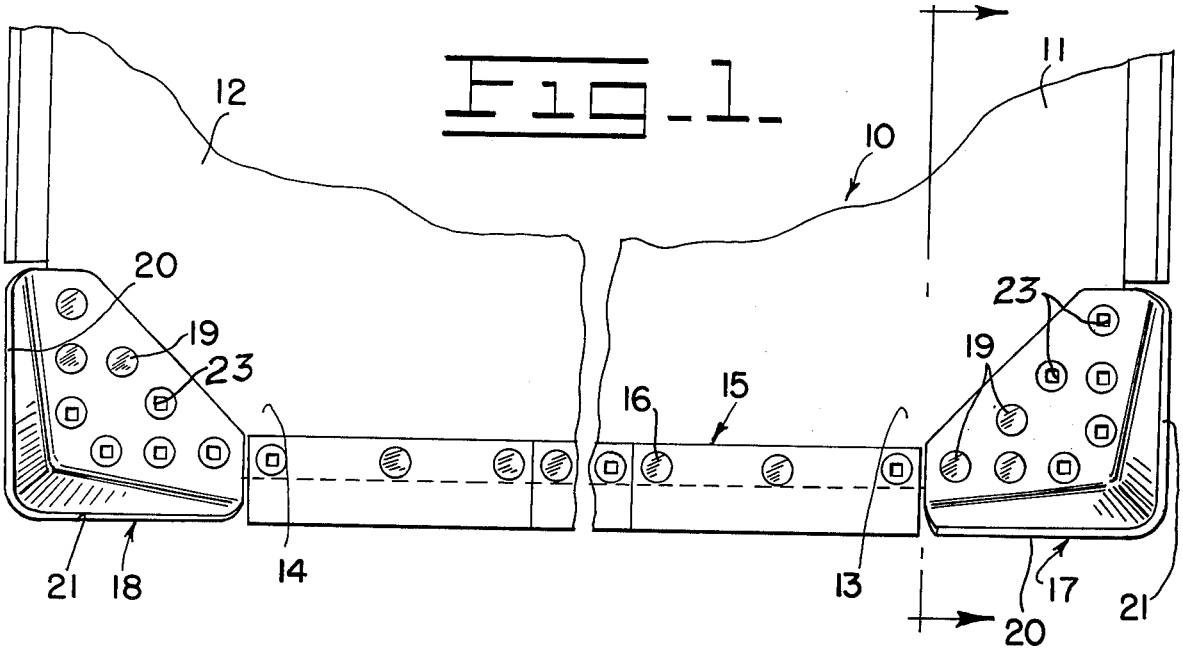
Fig. 1.
Fig. 2.
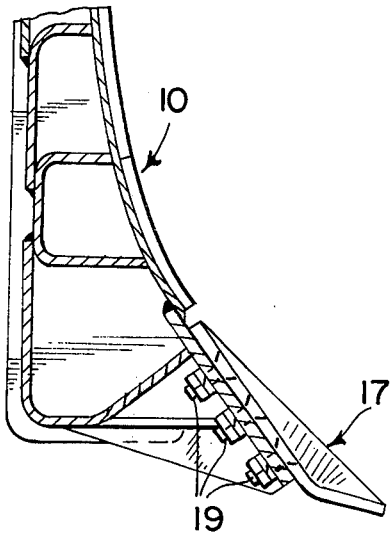
Fig. 3.
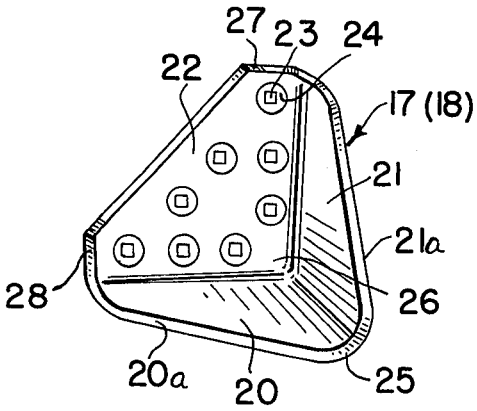

REVERSIBLE BLADE BIT

BACKGROUND OF THE INVENTION

1. Field of the Invention

This invention relates to earthworking apparatus and in particular to cutting bits for installation on the blade portions of such apparatus.

2. Description of the Prior Art

As disclosed in U.S. Pat. No. 2,831,275 of Woodrow P. Kinsey et al, owned by the assignee thereof, it is common to provide cutting bits on the blade portion of earthworking equipment, such as earth-moving scrapers and bulldozers. As disclosed in the Kinsey et al patent, such cutting bits are conventionally arranged to be secured to the outside of the scraper bowl by suitable bolts. Such bits effect a cutting action on the earth as the blade is moved forwardly to insure a clean cut. The use of the bits effectively extends the useful life of the blade by minimizing the erosion and wear of the blade proper so as to minimize expense and time consumption in repairing of the blade as a result of such erosion and wear.

In the Kinsey et al patent, the cutting bits are provided with a second set of cutting edges so that when one edge of the cutting bit becomes worn, the bit may be removed and reversely installed on the opposite wall of the scraper bowl so as to dispose the unused cutting surface forwardly and thereby provide extended useful life of the cutting bits.

In U.S. Pat. No. 3,190,018 of Maclay P. Nelson et al, a reversible bit is disclosed which is mounted on the blade by means entirely rearward of the cutting surfaces of the blade so as to provide protection for the mounting means, such as from impact against soil or rocks engaged by the bit or blade.

SUMMARY OF THE INVENTION

The present invention comprehends an improved form of reversible bit for selective mounting to an earthworking blade, and more specifically, is directed to such a bit for use at the opposite corner portions of the blade.

The invention comprehends the provision of such a reversible end bit defined by a rigid member having a first cutting edge portion, a second cutting edge portion extending transversely to the first cutting edge portion, and a mounting portion included between the cutting edge portions and adapted to be mounted to one corner portion of a blade with the first cutting edge portion in cutting position and to the opposite corner portion of the blade with the second cutting edge portion in cutting position.

More specifically, the rigid member may comprise a triangular member having substantially rectilinear cutting edge portions, with one cutting edge portion extending perpendicular to the other and with the mounting portion of the bit defining a generally triangular mounting portion.

The bit may be made symmetrical about a centerline bisecting the angle defined by the cutting edge portions so that selective rotation of the bit 90° about the apex of the bisecting centerline and triangular mounting portion disposes selectively either of the two cutting edge portions in cutting position when mounted to the opposite corners of the blade.

The cutting edge portions may project forwardly from the flat plane of the mounting portion so as to define mutual strengthening means.

The bit may be mounted to the blade corners by suitable bolts, which, by virtue of the triangular arrangement of the mounting portion may be spaced from the corner tip portions of the blade to provide improved minimum distortion mounting of the bits to the blade.

Thus, the reversible end bit of the present invention is extremely economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary front elevation of a bulldozer blade having reversible end bits embodying the invention;

FIG. 2 is a view taken along line 2—2 in FIG. 1; and

FIG. 3 is an isometric view of reversible end bits.

DESCRIPTION OF THE PREFERRED EMBODIMENT

In the exemplary embodiment of the invention as disclosed in the drawing, an earthworking blade generally designated 10 is shown to comprise a bulldozer blade having opposite end portions 11 and 12, respectively defining corner portions 13 and 14. A conventional elongated bit generally designated 15 may be secured to the mid-portion of the blade by suitable bolts 16.

The present invention is concerned with the provision of improved reversible end bits generally designated 17 amd 18 which, as shown in FIG. 1, are adapted to be mounted to the corner portions 13 and 14 of the blade 10 by suitable bolts 19. Bits 17 and 18 are identical comprising reversible end bits which may be selectively installed on either corner portion 13 or 14. For this purpose, each bit is provided with a first cutting edge portion 20 and a second cutting edge portion 21. As shown in FIG. 1, when the bit is installed on the right-hand corner portion 13, the cutting edge portion 20 is disposed lowermost in cutting position with the cutting edge portion 21 extending upwardly therefrom in a retracted position. When the bit is installed on the left-hand corner portion 14 of the blade, the cutting edge portion 21 is disposed lowermost in the cutting position with the cutting edge portion 20 extending upwardly in a retracted position.

Thus, the end bits may be installed on either end of the bulldozer blade by a simple 90° rotation of the bit.

More specifically, as seen in FIG. 3, each bit is defined by a rigid member having a first cutting edge portion 20 and a second cutting edge portion 21 with a mounting portion 22 included between the cutting edge portions and adapted to be mounted to the blade corner portion, as discussed above. The mounting portion may be provided with a plurality of holes 23 opening forwardly through recess portions 24 for receiving the bolt heads.

The cutting edge portions 20 and 21 may extend forwardly from the flat plane of the mounting portion 22 so as to dispose distal forward cutting edges **20*a* and 21*a***, respectively, substantially forwardly of the plane of the mounting portion.

As best seen in FIG. 3, the cutting edges **20*a* and 21*a* are inclined to the flat plane of the mouting portion with the maximum spacing thereof forwardly from the plane of the mounting portion being at a juncture 25 of the two cutting edge portions aligned with the apex 26 of the triangular mounting plate 22.**

In the illustrated embodiment, the cutting edge portions 20 and 21 are integrally joined at the juncture 25 and are integrally formed with the mounting plate portion 22 to define and integral one-piece bit construction.

The cutting edge portions may define inturned distal ends 27 and 28, respectively, which are turned to extend generally parallel to the other cutting edge portion at the opposite edge of the mounting plate portion 22. As shown, the distal portions 27 and 28 may run into the flat plane of the mounting portion 22.

Each of the cutting edge portions 20 and 21 may comprise generally planar portions along the two sides of the triangular mounting plate 22 extending from the apex 26. The planes of portions 20 and 21 along these edges may be inclined outwardly relative to the mounting plate whereby the bit effectively defines a forwardly widening structure. Thus, the cutting edge portions effectively define reinforcing or strengthening means as well as defining the cutting edges of the bit.

Referring to FIG. 3, the bolt holes 23 may be spaced from the apex 26 to provide an improved mounting of the cutting bits to the blade corner portions 13 and 14. Further, as the triangular arrangement of the mounting plate member provides mounting bolt holes remotely from the lowermost cutting edge, a further improved secure mounting of the end bits to the blade is effected.

In the illustrated embodiment, the end bits are symmetrical about a centerline extending from the apex and bisecting the angle defined by the forwardly projecting cutting portions 20 and 21. Thus, the end bits function identically in their mounting at either end of the cutting blade. Thus, with the triangular arrangement of the present end bits, the mutually interacting support provided by the forwardly projecting cutting edge portions provides a high strength, long life bit construction providing substantial improvement over the bit constructions of the prior art.

Referring to FIG. 2, it may be seen that the extending plates and relieved areas at each end of the blade provide ready access to bolts 19 and facilitate mounting and service of the end bits 17 and 18.

The foregoing disclosure of specific embodiments is illustrative of the broad inventive concepts comprehended by the invention.

We claim:

1. a reversible end bit for selective mounting to an earthworking blade having opposite corner portions, said bit comprising a one-piece rigid member having a first cutting edge portion, a second cutting edge portion extending transversely to said first cutting edge portion, and a mounting portion included between said cutting edge portions and adapted to be mounted to one corner portion of a blade with said mounting portion facially abutting the blade and said first cutting edge portion in forwardly projecting cutting position, and to the opposite corner portion of the blade with said mounting portion turned approximately 90° and facially abutting the blade and the second cutting edge portion in forwardly projecting cutting position, said member being substantially symmetrical about a centerline bisecting the angle defined by said cutting edge portions and said mounting portion.

2. The reversible bit of claim 1 wherein said mounting position comprises a generally triangular flat plate portion.

3. The reversible bit of claim 1 wherein said mounting portion defines a corner and said cutting edge portions are connected along a joint extending forwardly from said corner.

4. The reversible bit of claim 1 wherein said cutting edge portions are substantially flat.

5. The reversible bit of claim 1 wherein said mounting portion is provided with bolt mounting holes for use in attaching the bit selectively to the blade corner portions, said holes being arranged symmetrically at opposite sides of said centerline.

6. The reversible bit of claim 1 wherein each said cutting edge portion defines a distal end turned to extend generally parallel to the other cutting edge portion.

* * * * *

UNITED STATES PATENT AND TRADEMARK OFFICE

CERTIFICATE OF CORRECTION

PATENT NO. : 4,044,481

DATED : August 30, 1977

INVENTOR(S) : LARRY G. EFTEFIELD; PAUL J. LUKAVICH

It is certified that error appears in the above-identified patent and that said Letters Patent are hereby corrected as shown below:

Column 1, line 11, cancel "thereof" and substitute therefor --hereof--

Column 2, line 35, cancel "amd" and substitute therefor --and--

Column 3, line 8, cancel "and" and substitute therefor --an--.

Column 4, line 26 (Claim 2), before "comprises" cancel "position" and substitute therefor --portion--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*